United States Patent [19]

Peterson

[11] 4,298,143

[45] Nov. 3, 1981

[54] TIME-CONTROLLED DEVICE FOR PREVENTING POURING OF STALE COFFEE FROM FLASKS

[76] Inventor: Charles J. Peterson, 214 W. Vine, Springfield, Ill. 62704

[21] Appl. No.: 959,930

[22] Filed: Nov. 27, 1978

[51] Int. Cl.[3] ..... B67D 5/08; G04C 23/38

[52] U.S. Cl. ..... 222/70; 222/504; 222/517; 251/133

[58] Field of Search ..... 222/70, 504, 517, 560, 222/556, 544, 192; 251/133; 220/90.2; 99/323; 58/48; 206/536, 538, 539, 540; 221/15; 194/59

[56] References Cited

U.S. PATENT DOCUMENTS

| | | | |
|---|---|---|---|
| 2,289,880 | 7/1942 | Frank | 222/560 X |
| 2,953,280 | 9/1960 | Scarboro | 221/15 |
| 3,018,056 | 1/1962 | Montgomery | 222/70 X |
| 3,363,439 | 1/1968 | Kende | 221/15 X |

FOREIGN PATENT DOCUMENTS

| | | | |
|---|---|---|---|
| 567223 | 12/1958 | Canada | 222/70 |

*Primary Examiner*—Robert J. Spar
*Assistant Examiner*—Fred A. Silverberg
*Attorney, Agent, or Firm*—Ralph F. Staubly

[57] ABSTRACT

A somewhat resilient stopper seals the throat of a conventional glass coffee-maker flask and is provided with a pouring passage. The passage is valved by a horizontally swingable blade spring-biased toward its passage-closing position but movable to its passage-opening position by a timer-controlled mechanism. The timer can be set for different time periods by a manually movable member which can either be normally fixed to the timer or be easily removable so that it can be retained at the coffee-making station to insure against purpose-defeating resetting.

6 Claims, 8 Drawing Figures

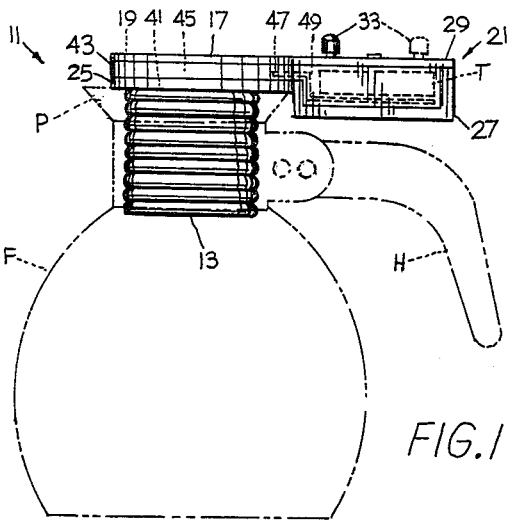
FIG. 1
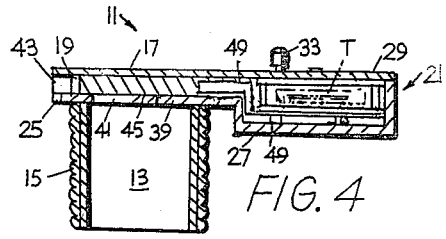
FIG. 4
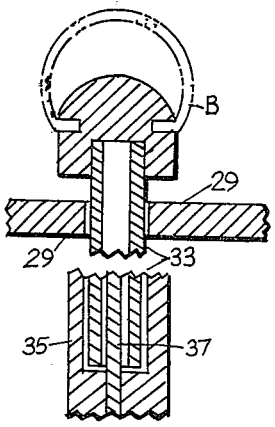
FIG. 8
FIG. 5
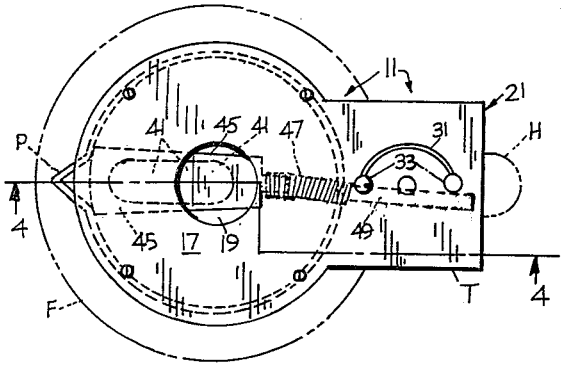
FIG. 2
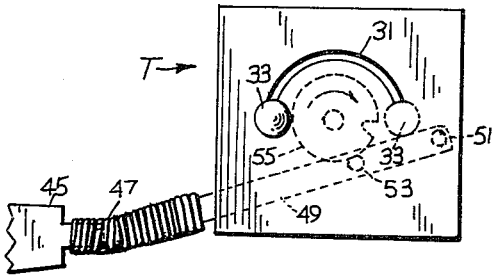
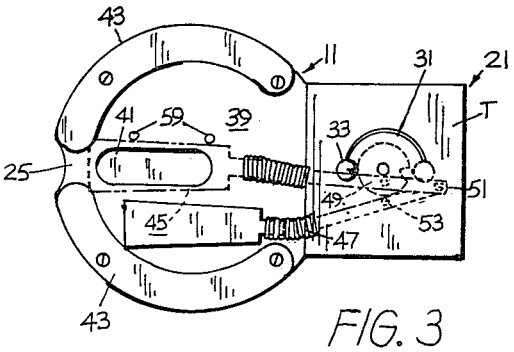
FIG. 3
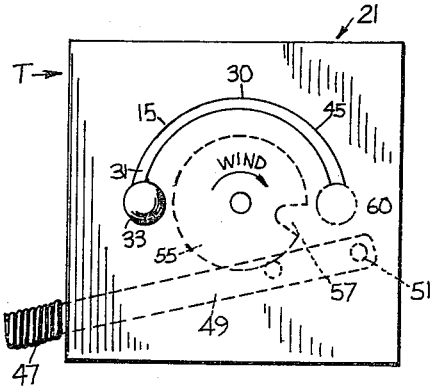
FIG. 6
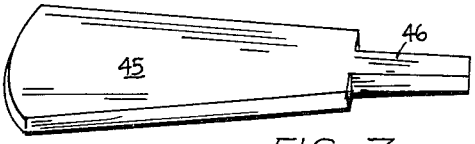
FIG. 7

TIME-CONTROLLED DEVICE FOR PREVENTING POURING OF STALE COFFEE FROM FLASKS

BACKGROUND AND OBJECTS OF THE INVENTION

It is well-known that brewed coffee rapidly deteriorates in flavor, especially when its container is left sitting on a hot plate, as is customary in restaurants. It is also generally agreed that coffee brewed and kept hot for more than an hour should not be served to discriminating customers. It is accordingly the object of the present invention to provide a device insertable into the throat of a conventional coffee-maker flask and having a pouring passage therethrough controlled by a valve operated by a timer for closing the pouring passage at the end of a preselected time period. Other objects and advantages will appear as the following detailed description proceeds.

BRIEF DESCRIPTIONS OF THE DRAWINGS

FIG. 1 is a side elevational view of a preferred embodiment of the invention.

FIG. 2 is a plan view of the showing of FIG. 1.

FIG. 3 is a plan view similar to FIG. 2 but with the top plate removed.

FIG. 4 is a side elevational view of the disclosure of FIG. 2 in section taken on the line 4—4 of FIG. 2.

FIG. 5 is an enlarged fragmentary plan view of the timer unit of FIG. 3.

FIG. 6 is a further enlarged fragmentary plan view of the timer of FIGS. 3 and 5.

FIG. 7 is a perspective view of the valve vane best shown in FIG. 3.

FIG. 8 is an enlarged fragmentary elevational view of the removable key-like timer-setting member in vertical axial section.

DETAILED DESCRIPTION

With reference now to the drawings, the numeral 11 generally designates the timer-operated pouring-controlling device. Device 11 comprises basically (1) a plastic cylindrical body 13, covered by a resilient sleeve 15, for sealingly plugging the throat of a conventional glass coffee-maker flask F; (2) a cap unit 17 having a shallow, laterally expanded flow passage 19 therein; and (3) a handle-overlying extension 21 housing a mechanical timer T of known construction.

The cylindrical body 13 has an integral peripheral flange 25 which rests on the rim of the flask F. The flange 25 is cut away at its front edge to provide a pouring space over the pouring lip P of the flask F. The flange 25 has an integral stepped extension 27 overlying the handle H of the flask, and providing part of the housing for the timer T.

The cap unit 17 is a disc-shaped plastic sheet having a rearwardly extending rectangular portion 29 that serves as a cover for the timer T. The cover portion 29 has an arcuate slot 31 formed therein to receive the arcuately movable vertically disposed capped pin 33 which is the spring-motor-winding-up and time-setting element of the timer T.

As shown in FIG. 8, the cap of the pin 33 is provided with diametrically opposite depressions to receive the inturned ends of a heavy-wire bail B by which the removable species of the pin 33 can be tied or chained to the coffee-making station. In this form, the pin 33 can be a key-providing tube which snugly enters the upwardly open bore of timer setter 35 over and around a pin 37. Said pin 37 would prevent a solid rod from being used to reset the timer and to defeat the purpose of the keyed setter.

The flow passage 19 is defined by the cap unit 17 and by the integral horizontal disc portion 39 of the body 13. The disc portion 39 is cut away at 41 to allow coffee to flow into the horizontally expanded flow passage 19 when the flask F is tilted in pouring. Two flat and arcuate plastic bodies 43 space the disc portion 39 and the cap 17 to form said passage 19, which opens over the pouring lip P of the flask F.

A plastic valve vane 45 is slightly thinner than the flow passage 19 and is large and wide enough to cover the valve opening 41. The valve vane 45 has a finger 46 sized to retain a coil spring 47 thereon. The coil spring 47 is similarly connected to the end of a Z-shaped arm 49, which is pivoted (at 51) at its other end to the bottom plate of timer T. The arm 49 has an upstanding pin 53 for engaging a circular cam 55 exposed on the bottom plate of the timer T. The cam 55 is notched at 57 to permit the pin to enter, at the expiration of a set time period, due to the straightening action of the coil spring 47. Upright pins 59 (FIG. 3) are fixed to the disc portion 39 to prevent the valve vane 45 from swinging pass the valve opening 41. The timer T can be one commercially available (No. R-20) from Intermatic Timers, Inc., Intermatic Plaza, Spring Grove, Illinois.

The spacers 43 optionally may be integrally molded either on the disc portion 39 or on the cap 17. Also the timer optionally could be vertically, rather than horizontally, disposed above the handle.

The invention having been described, what is claimed is:

1. A time-controlled device in combination with, and for preventing the pouring of stale coffee from a conventional coffee-maker flask, comprising: a generally cylindrical stopper for closing the throat of said flask and having a pouring passage therethrough, valve means movable between passage-closing and passage-opening positions, means for moving the valve means between the passage opening and the passage closing positions, and a seperate manually settable mechanical timer means cooperating with said means for moving for providing timer-delayed automatic movement of said valve means from its passage-opening position to its passage-closing position.

2. A device according to claim 1, said means for moving including lever-and-spring means for biasing and moving said valve means toward its passage-closing position when timer-released.

3. A device according to claim 2, said means for moving also including means interconnecting said valve means and said settable timer means for their simultaneous opening and setting respectively.

4. A device according to claim 2, said timer means also including a cam disc for co-operating with said lever-and-spring means to control said valve means.

5. A device according to claim 1, said manually settable means being protectively positioned above the handle of said flask.

6. A device according to claim 1, said manually settable timer means having a key-like removable setting member for optional retention at a coffee-making station to deter improper operation.

* * * * *